US008820873B2

(12) United States Patent
Tanase et al.

(10) Patent No.: US 8,820,873 B2
(45) Date of Patent: Sep. 2, 2014

(54) PRINTING APPARATUS AND PRINTING METHOD

(75) Inventors: Kazuyoshi Tanase, Matsumoto (JP); Toru Takahashi, Azumino (JP); Takamitsu Kondo, Shiojiri (JP); Hiroshi Wada, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 157 days.

(21) Appl. No.: 13/428,432

(22) Filed: Mar. 23, 2012

(65) Prior Publication Data

US 2012/0242737 A1 Sep. 27, 2012

(30) Foreign Application Priority Data

Mar. 23, 2011 (JP) ..... 2011-064385

(51) Int. Cl.

| | |
|---|---|
| ***B41J 29/38*** | (2006.01) |
| ***B41J 2/01*** | (2006.01) |
| ***B41J 11/00*** | (2006.01) |
| *B41M 7/00* | (2006.01) |

(52) U.S. Cl.

CPC ..... *B41J 11/002* (2013.01); *B41M 7/0081* (2013.01); *B41M 7/00* (2013.01)

USPC ..... 347/16; 347/102

(58) Field of Classification Search

CPC ..... B41J 13/0009; B41J 11/002

See application file for complete search history.

(56) References Cited

U.S. PATENT DOCUMENTS

| | | | | |
|---|---|---|---|---|
| 6,712,463 | B2 * | 3/2004 | Matsumoto | 347/104 |
| 7,597,438 | B2 * | 10/2009 | Konno et al. | 347/102 |
| 2006/0284953 | A1 * | 12/2006 | Hatasa et al. | 347/105 |

FOREIGN PATENT DOCUMENTS

| | | |
|---|---|---|
| JP | 4321050 B2 | 8/2009 |

* cited by examiner

*Primary Examiner* — Shelby Fidler
*Assistant Examiner* — Tracey McMillion
(74) *Attorney, Agent, or Firm* — Global IP Counselors, LLP

(57) ABSTRACT

A printing apparatus: the medium-conveying part conveying the medium; the nozzles discharging ink droplets curable by light irradiation onto the medium; the light-irradiation part irradiating the medium with light; the medium-deforming part being arranged on the downstream side of the light-irradiation part, holding the medium from the front and back, and deforming the medium so that an irregular shape is formed in cross section; the controller performing an image-forming step, a light-irradiating step, and a medium-deforming step; in the image-forming step, the ink droplets being discharged by the nozzles to form an image on the surface of the medium; in the light-irradiating step, the ink droplets discharged onto the medium being irradiated with light by the light-irradiation part to cure the droplets; and in the medium-deforming step, the medium being released by the medium-conveying part after the medium is deformed by the medium-deforming part.

7 Claims, 10 Drawing Sheets

PRINTING APPARATUS AND PRINTING METHOD

CROSS-REFERENCE TO RELATED APPLICATIONS

This application claims priority to Japanese Patent Application No. 2011-064385 filed on Mar. 23, 2011. The entire disclosure of Japanese Patent Application No. 2011-064385 is hereby incorporated herein by reference.

BACKGROUND

1. Technical Field

The present invention relates to a printing apparatus in which ink cured by irradiation with light is used. The invention also relates to a method for preventing uneven gloss on an image printed using the printing apparatus.

2. Background Technology

Inkjet printers for discharging ink onto a medium to form an image belong to the class of printing apparatuses. In such of these inject printers, images are printed using ink that is irradiated with ultraviolet light or other light and cured (for example, refer to Patent Citation 1). In inkjet printers that use such light-curable ink, the occurrence of bleeding (running) caused by combinations of ink droplets can be suppressed by curing the ink droplets discharged on the medium with light.

Japanese Patent Registration No. 4321050 (Patent Citation 1) is an example of the related art.

SUMMARY

Problems to be Solved by the Invention

In inkjet printers in which light-curable ink is used, a problem arises in which unevenness in gloss level occurs in correspondence with the amount of ink per unit area on the medium. For example, the gloss level is low in sections in which the amount of ink is sparse, such as those displaying the color of skin or the like. Conversely, the amount of ink is considerable and the gloss level is high in solidly filled sections such as those of a pupil or the like. Therefore, in a case in which a human face is the printed image, the gloss levels vary according to the position on the face, resulting in an unnatural image.

An advantage of the invention is to provide a printing apparatus capable of printing an image having even gloss levels even when the amount of ink is unevenly distributed on the medium. Additional advantages will be made apparent in the descriptions below.

Means Used to Solve the Above-Mentioned Problems

The primary invention, which was devised to achieve the aforementioned advantage, provides a printing apparatus for depositing ink droplets on a surface of a medium to form an image;

the printing apparatus including a medium-conveying part, nozzles, a light-irradiation part, a medium-deforming part, and a controller for controlling the parts;

the medium-conveying part conveying the medium so that the medium supplied from an upstream side is released on a downstream side;

the nozzles discharging ink droplets curable by light irradiation onto the medium;

the light-irradiation part irradiating the medium with light;

the medium-deforming part being arranged on the downstream side of the light-irradiation part, holding the medium from the front and back, and deforming the medium so that an irregular shape is formed in cross section;

the controller performing an image-forming step, a light-irradiating step, and a medium-deforming step;

in the image-forming step, the ink droplets being discharged by the nozzles to form an image on the surface of the medium;

in the light-irradiating step, the ink droplets discharged onto the medium being irradiated with light by the light-irradiation part to cure the droplets; and in the medium-deforming step, the medium being released by the medium-conveying part after the medium is deformed by the medium-deforming part.

Other characteristics of the invention are made apparent from the descriptions of the specification and the attached drawings.

BRIEF DESCRIPTION OF THE DRAWINGS

Referring now to the attached drawings which form a part of this original disclosure.

DETAILED DESCRIPTION OF EXEMPLARY EMBODIMENTS

Gloss Level

The gloss level of a printed image is dependent on the state of the light reflected from a medium struck by natural light. For example, the gloss level is low when the reflected light is diffused; this state is referred to as "matte." Conversely, a high gloss level can be obtained when the light approaches specular reflection; this state is referred to as "glossy." Unevenness in the gloss level of printed images occurs in inkjet printers in which light-curable ink is used, as described above. In general terms, gloss level is dependent on the amount of ink per unit area on the medium, that is, on the amount of ink droplets (ink drops) sprayed onto the medium.

Figure 1A:
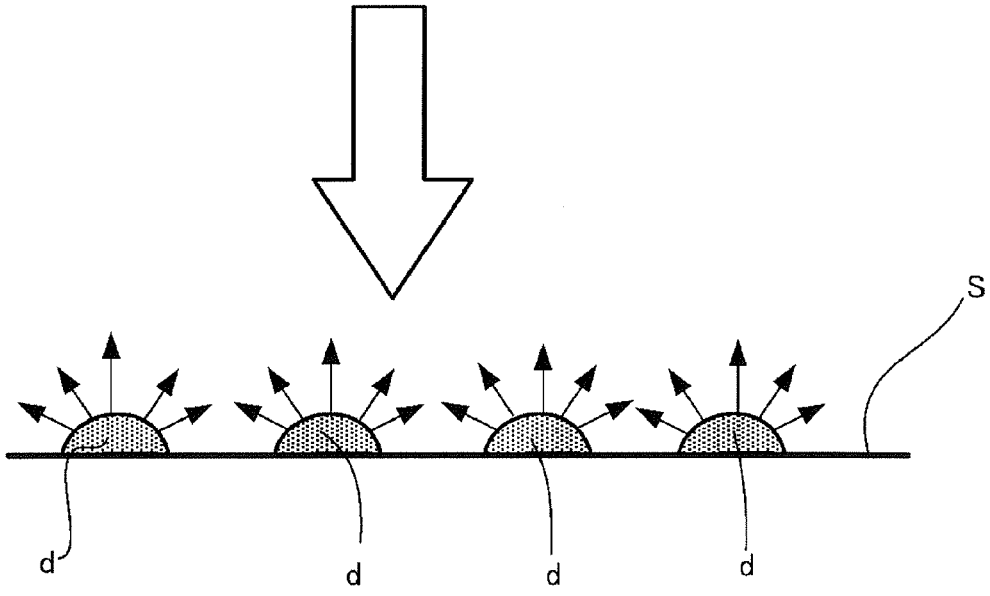
FIG. 1 is a view showing the principle by which uneven gloss occurs on an image printed by an inkjet printer in which light-curable ink is used.

FIG. 1 is a schematic view showing uneven gloss on an image printed by an inkjet printer in which light-curable ink is used. For example, in a case in which a human face is printed as an image, the cheeks or other parts are a pale skin color. The amount of ink droplets (ink drops) "d" impinging on a printed area having this pale color is small. The ink drops "d" are cured by ultraviolet light (UV) or other light, and independent islets having a shape resembling a hemisphere are therefore formed without the blurring of the ink drops "d" on a medium S, as shown in FIG. 1A. Specifically, the density of the ink drops "d" is "sparse." Accordingly, light (white arrow in the drawing) incident on the surface of the medium S is reflected (solid arrows in the drawing) in various directions by the surface of the islet-shaped ink drops "d". Specifically, diffuse reflection results.

Figure 1B:
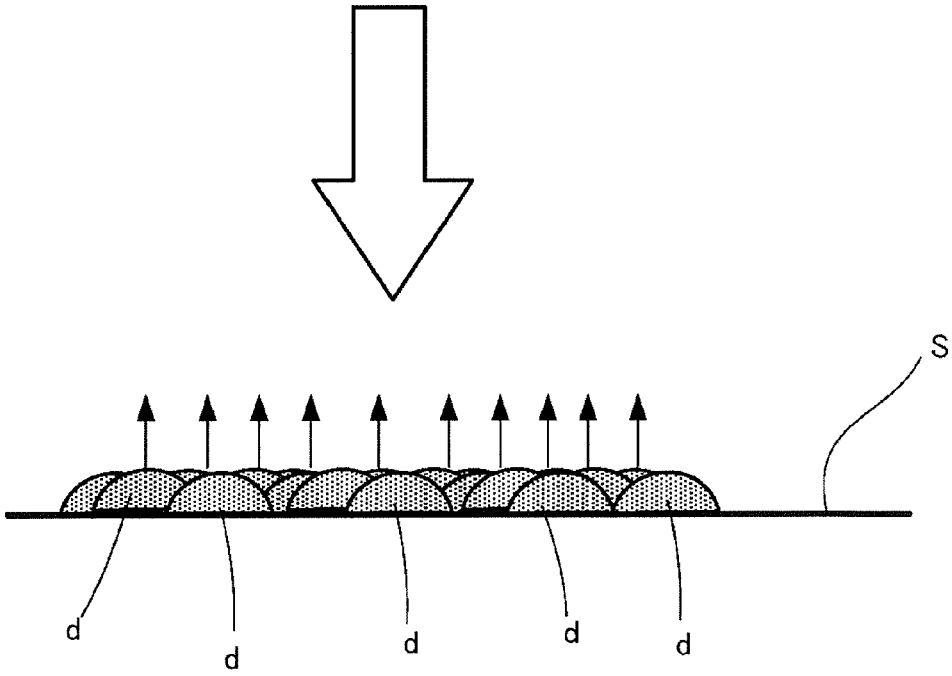

In contrast, the pupil or other dark-colored section is expressed by entirely filling the image area, as shown in FIG. 1B. Specifically, the adjacent ink drops "d" are densely arranged in the image area, resulting in a state that is similar to one in which a film-like ink covers the medium S, even if individual ink drops "d" have a hemispherical shape. Incident light is therefore reflected in a substantially specular manner by the film-shaped ink surface, and the gloss level increases. Accordingly, in human faces and the like, cheeks and other sections having skin are matte, and sections having pupils are glossy, resulting in an unnatural image lacking uniformity in gloss level.

Figure 2:
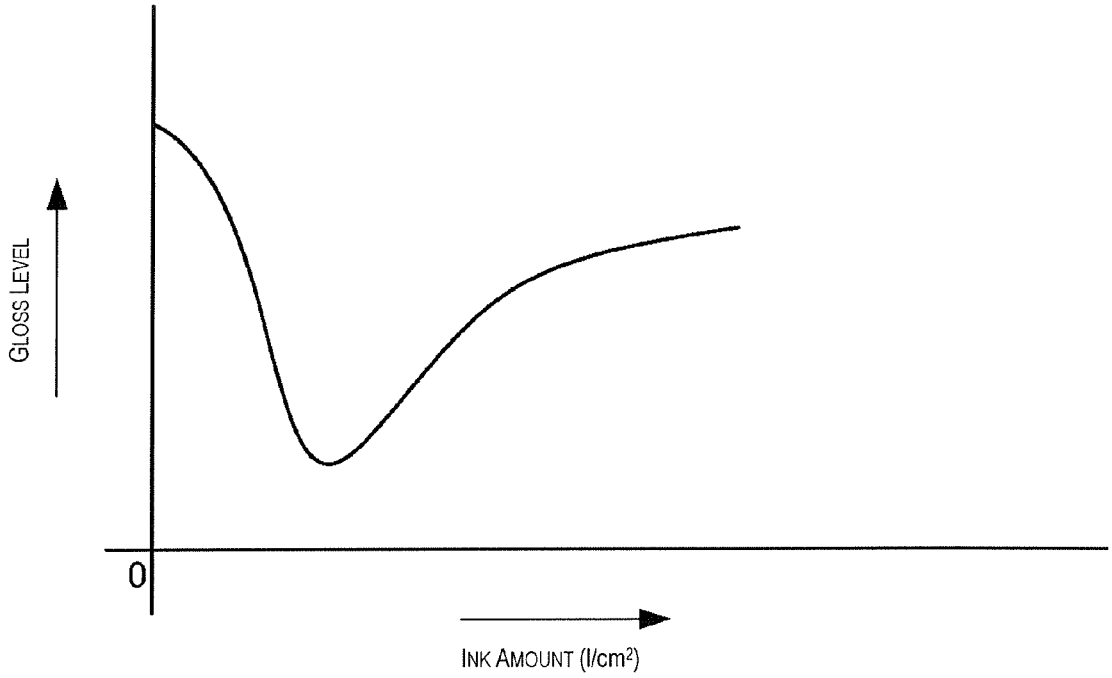
FIG. 2 is a view showing the relationship between the amount of ink per unit area on a medium and the gloss level.

The aforementioned is a summary of causes of uneven gloss. However, the mechanism for producing uneven gloss schematically shown in FIG. 1 is a model that has been simplified to a certain degree; in reality, uneven gloss does not simply depend exclusively on the density of the ink drops "d". FIG. 2 shows the relationship between the density of ink on the medium S and the gloss level. The drawing shows the relationship between the amount of ink (volume) per unit area on the medium S and the gloss level measured using a known gloss meter (gloss checker). The gloss level of the medium S is reflected when the amount of ink is very low, and the diffuse reflection component caused by the sparsely arranged ink drops "d" increases with an increased amount of ink, causing a decrease in the gloss level. The specular reflection component increases in relative terms when the amount of ink per unit area exceeds a designated amount, shifting the gloss level toward higher levels. In addition, the gloss level differs depending on the type of the medium S, and the relationship between the amount of ink and the gloss level therefore becomes more complicated when different types of mediums S are used for various purposes.

Embodiments of the Invention

As described above, uneven gloss occurs due to the density of the ink drops on the medium in a printer in which light-curable ink is used. Moreover, the density of ink drops and the gloss level are not in a simple proportional relationship, making it impossible for the uneven gloss on the same medium to be eliminated by simply making the gloss level uniform over the entire image by using glossy paper, matte paper, or another surface-treated medium. Reforming the ink is a consideration, but the physical properties related to the gloss level of the ink must be optimized without losing the original characteristic of the light-curable ink, that is, the ability to suppress bleeding. Furthermore, the ink discharge method and the like suitable to the physical properties of the ink must also be optimized. The development and research of ink, discharge control, and other peripheral technologies therefore require extensive time and cost to develop. In view of this, a goal was set to achieve a uniform gloss level in matte, that is, to change the technical thinking, by physically modifying the cross-sectional shape of the medium rather than by reforming the ink or surface-treating the medium.

The printing apparatus according to this embodiment can be provided with the below-described characteristics in addition to the characteristics provided by an embodiment corresponding to the primary aspect of the invention.

The medium-deforming part is configured from rollers for holding the medium while being orthogonal to the conveying direction of the medium, and irregularities are formed on the surface of one of the rollers. The printing apparatus can be including a heating part for applying heat to the rollers, the rollers being made to facilitate the curing of the ink droplets by applying heat to the medium when the medium is deformed. In addition, the printing apparatus can be characterized in that the surface of the medium on which the ink droplets are deposited is the front surface, the roller provided with irregularities is arranged facing the rear surface of the medium, and the roller provided with an elastic surface and formed from a material lacking any irregularities is arranged facing the front surface.

In any of the embodiments, the printing apparatus can be characterized in that:

the light-irradiation part arranged downstream of the head part further includes a temporary-curing irradiation part on the upstream side, and a permanent-curing irradiation part on the downstream side;

the medium-deforming part is arranged on the downstream side of the temporary-curing irradiation part and on the upstream side of the permanent-curing part;

the controller performs a temporary curing step and a permanent curing step, and performs the light-irradiating step after the temporary curing step;

the temporary-curing irradiation part irradiates light for preventing the flow of the ink droplets;

the permanent-curing irradiation part irradiates light having higher energy in comparison with the light irradiated by the temporary-curing irradiation part;

in the temporary curing step, the ink droplets deposited on the medium by the nozzles are irradiated with light by the temporary-curing irradiation part; and in the permanent curing step, the ink droplets irradiated with light in the temporary curing step are irradiated with light, cured, and fixed to the medium.

Alternatively, the controller performs a temporary curing step and a permanent curing step, and can perform the medium-deforming step after the permanent curing step.

In addition, an example of the invention further provides a printing method using a printing apparatus in which light-curable ink is discharged as droplets from nozzles and deposited on a medium, the deposited droplets are irradiated with light and cured, and an image composed of minute dots is formed on the medium; the printing method characterized in that the printing apparatus performs a step for deforming the medium so that an irregular shape is formed in cross section after a step for irradiating the droplets deposited on the medium with light to cure the droplets.

Basic Configuration and Operation of Printer

Figure 3:
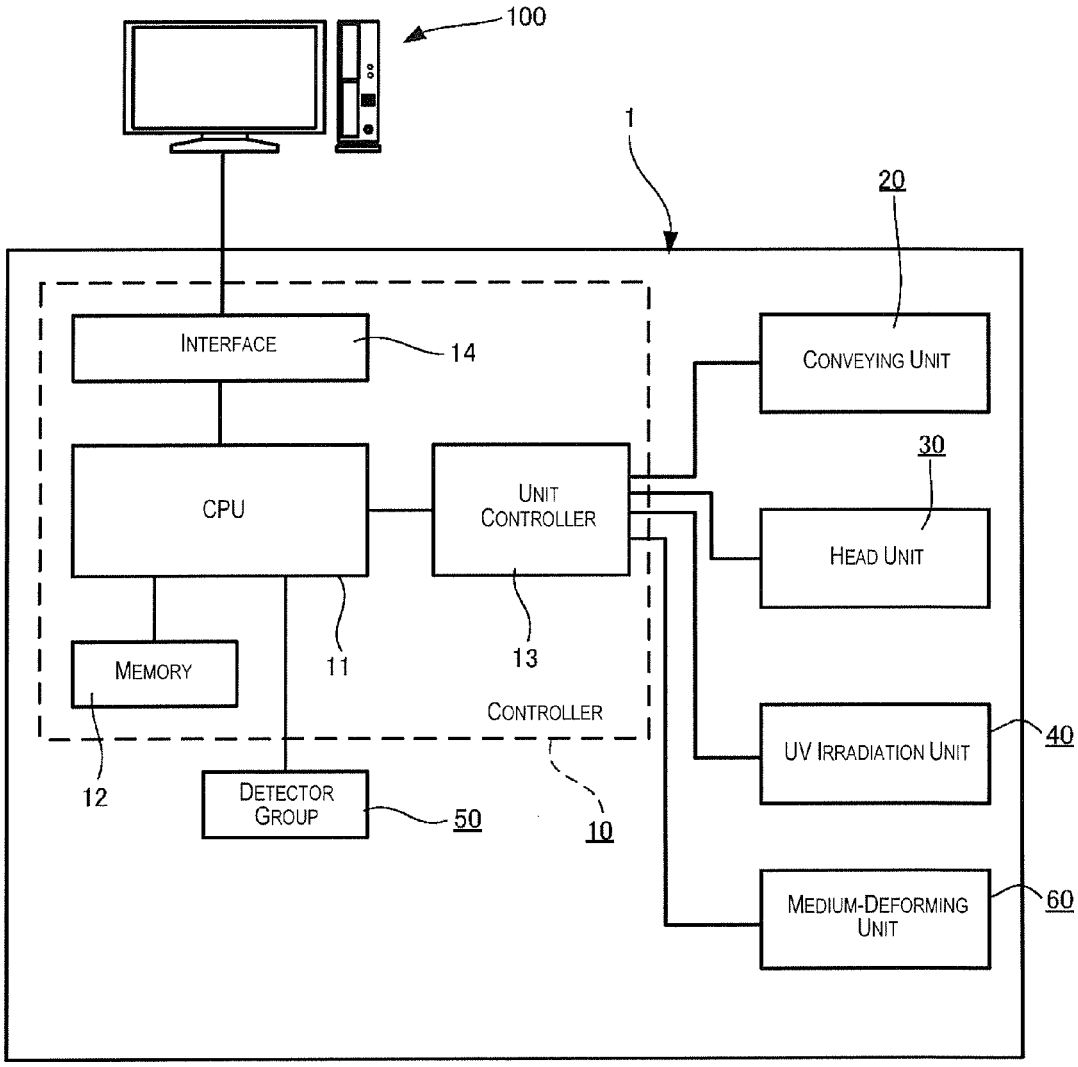
FIG. 3 is a block diagram of a printer according to an embodiment of the invention.
Figure 4:
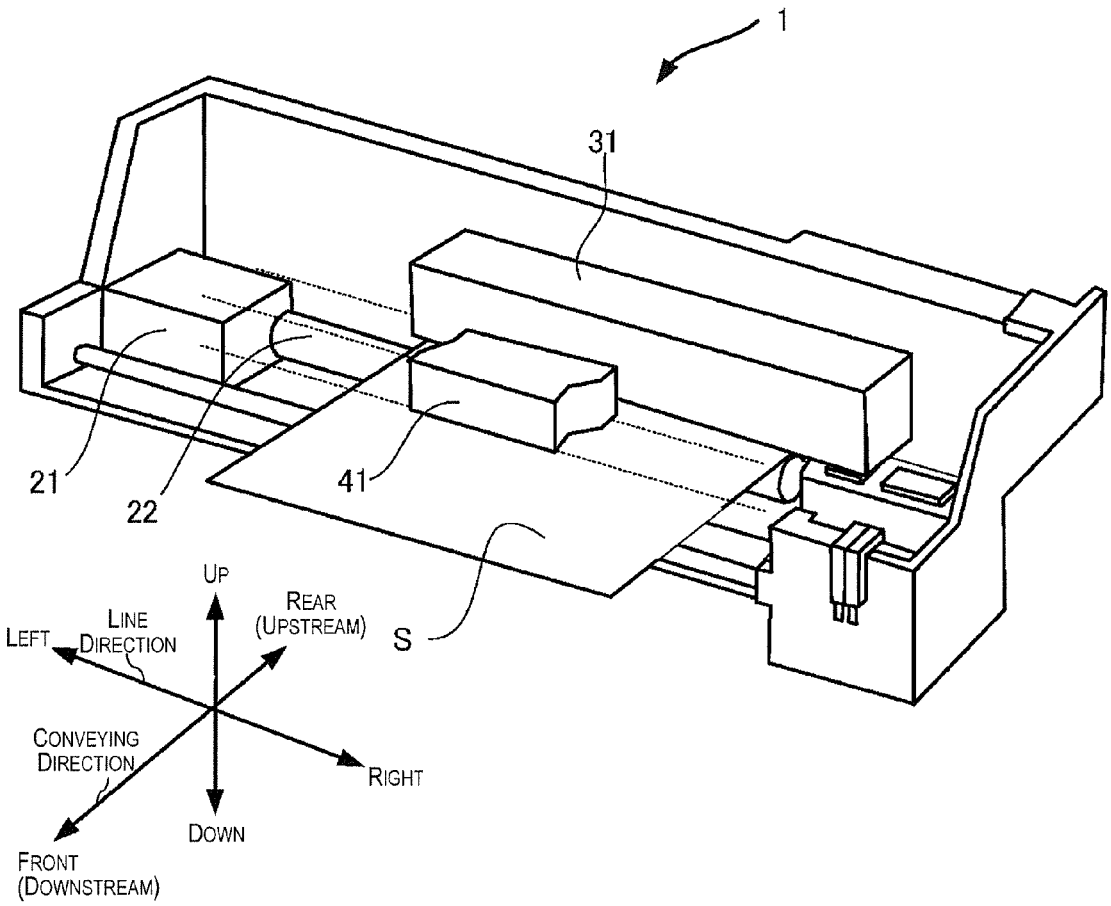
FIG. 4 is a cutaway perspective view of the printer in the embodiment.

An inkjet printer (hereinafter referred to as a "UV printer") of a type in which UV ink is cured by ultraviolet irradiation is given as a more specific embodiment of the invention. The overall configuration of the UV printer 1 according to this embodiment is shown in FIG. 3 as a block diagram. In addition, a schematic configuration of the UV printer 1 is shown as a cutaway perspective view of the UV printer 1 as viewed from above front. The basic configuration and operation of the UV printer 1 according to an embodiment of the invention are described herein on the basis of FIGS. 3 and 4, and on the basis of appropriate drawings shown below.

A controller 10 is a control unit for controlling the UV printer 1. The controller includes a CPU 11 as a processorcontroller, a memory 12 having a storage area for a program performed by the CPU 11 and an operating area for the program, a unit controller 13 for controlling the operation of individual units (20 to 60), an interface (IF) 14 for transmitting data between a computer 100, which is an external device, and the CPU 11, and the like.

Figure 5:
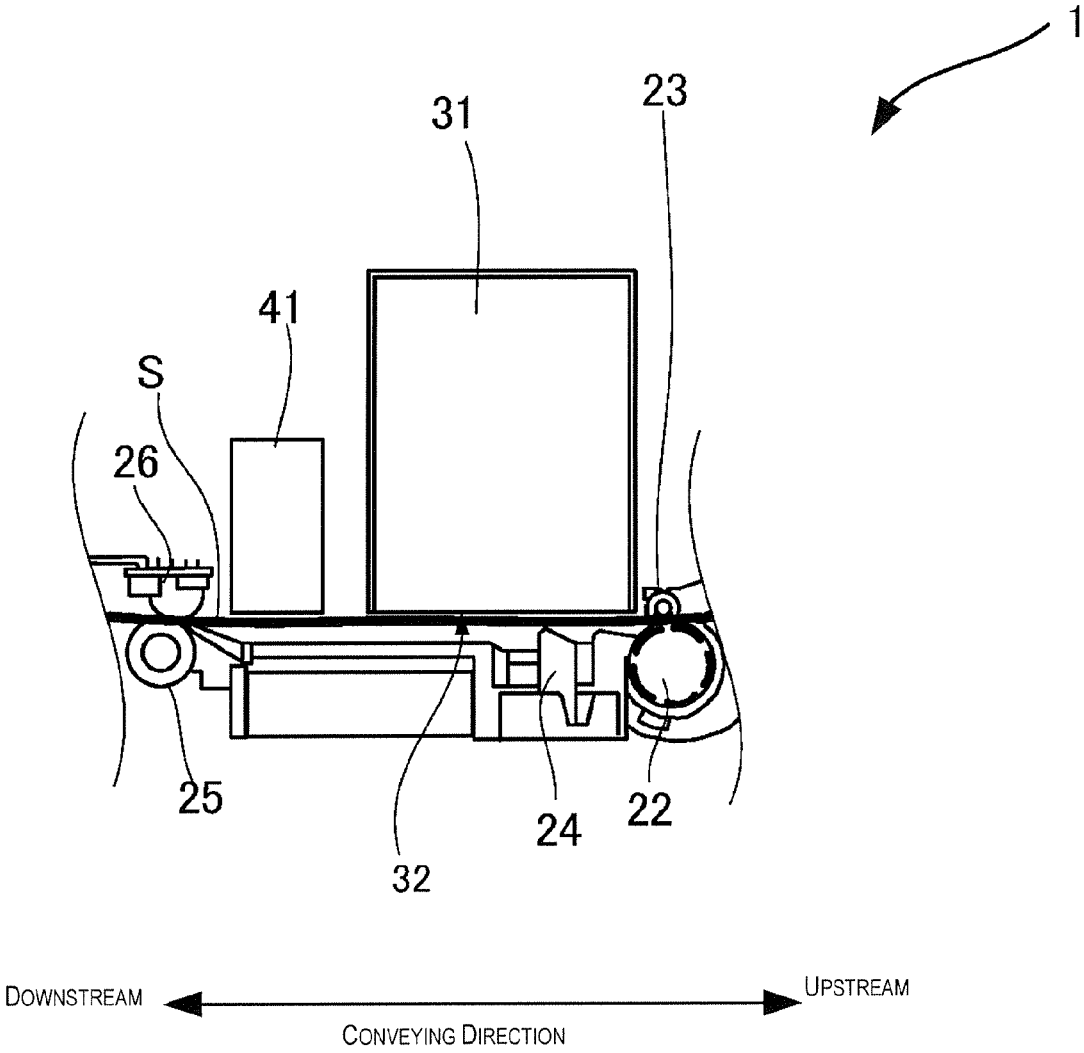
FIG. 5 is a view showing a schematic configuration of a medium-conveying mechanism of the printer in the embodiment.

A conveying unit 20 includes a mechanism or circuit for conveying paper or another medium S in a designated direction. In this example, the rearward direction of the UV printer 1 is upstream, the frontward direction is downstream, and the medium S is conveyed so as to be supplied from the upstream side and released from the downstream side. FIG. 5 shows a schematic configuration of the mechanism for conveying the medium S in the conveying unit 20. Using the conveying mechanism, the medium S inserted into an insertion opening for the medium S is fed into the UV printer 1 by a feed roller (not shown), a conveying roller 22 rotatably driven by a conveying motor 21 sandwiches the medium S together with a driven roller 23, and the medium S is conveyed to an area where printing can be performed. In addition, the medium S is conveyed during printing toward downstream while being supported by a platen 24. An ejecting roller 25 that rotates in synch with the conveying roller 22 sandwiches the printed medium S together with the driven roller 26 and releases the medium S to the downstream side.

A detector group 50 includes sensors for detecting the various states inside of the UV printer 1, each of the sensors included in the detector group 50 outputs the detection results (detection data) to the controller 10, and the controller 10 performs feedback control on each of the units on the basis of the detection data. The detector group 50 can, for example, include a rotary encoder for detecting the rotations of the conveying roller 22, and other sensors.

Figure 6:
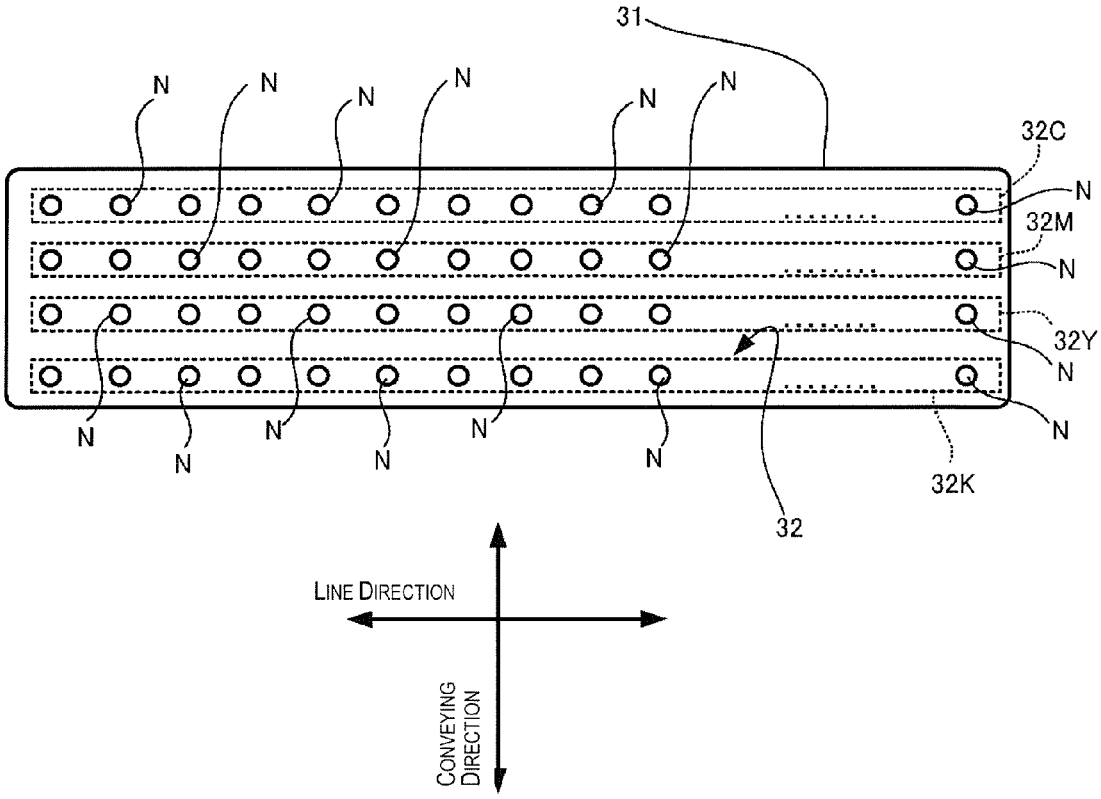
FIG. 6 is a view showing nozzle rows of a head of the printer in the embodiment.
Figure 7A:
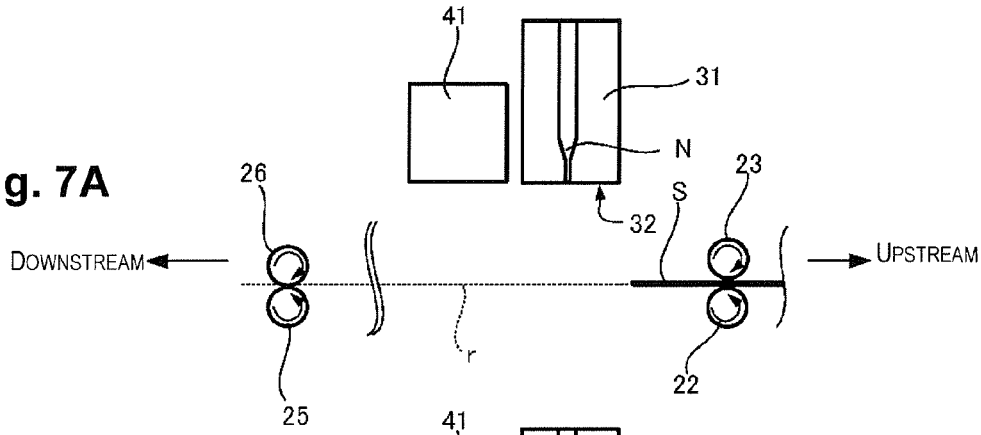
FIG. 7 is a view showing the printing operation of the printer in the embodiment.
Figure 7B:
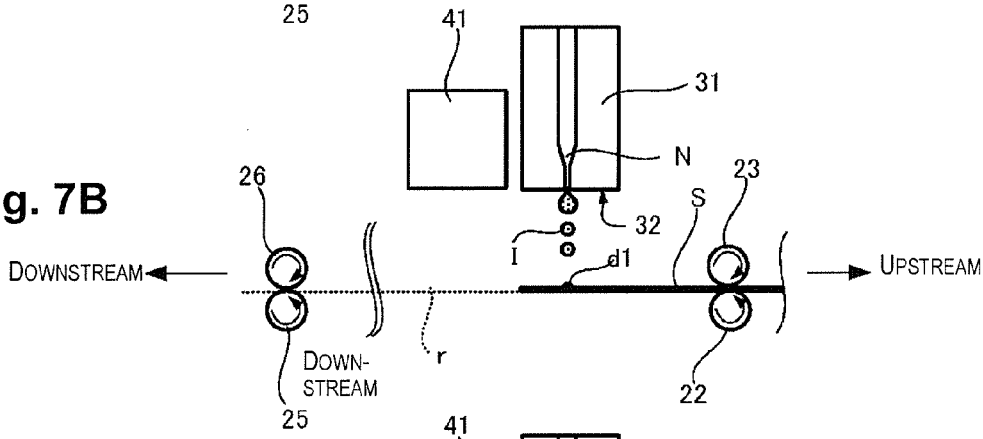
Figure 7C:
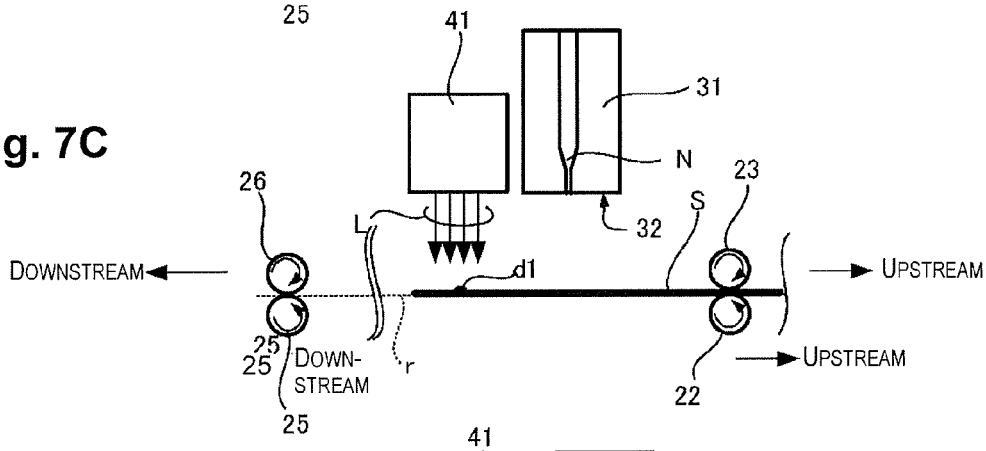
Figure 7D:
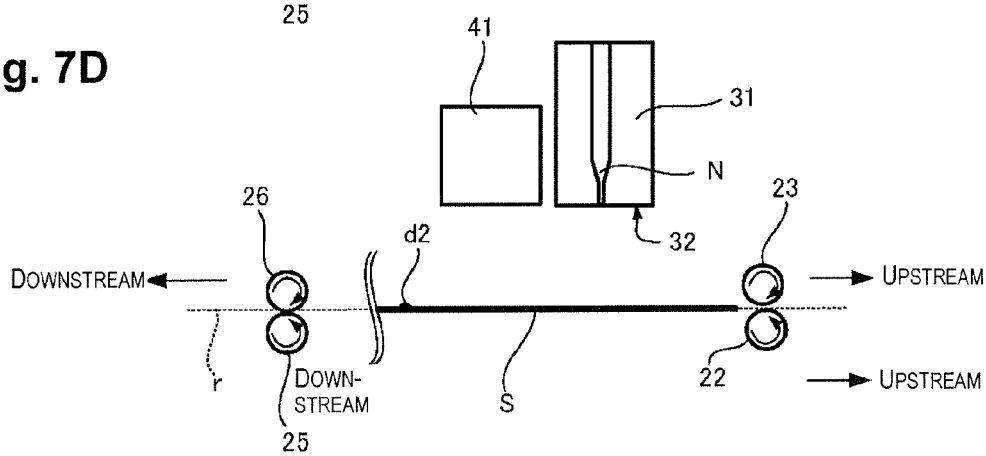

A head unit 30 is adapted to discharge ink toward the medium S, and is configured so as to include, in addition to a nozzled head 31, ink tanks, a pump for supplying ink to the head 31 from the ink tanks, and the like. The UV printer 1 shown here is a line printer arranged so that the head 31 provided with ink-discharging nozzles on the lower surface 32 thereof extends in the widthwise direction (hereinafter referred to as the "line direction") orthogonal to the conveying direction of the medium S. Multicolored ink for multicolor printing is loaded into individual ink tanks. An example of the nozzle arrangement of the head 31 is shown in FIG. 6. A plurality of nozzles N opens in a side-by-side arrangement at regular intervals in the line direction on the lower surface 32 of the head 31, and nozzle rows (33C, 33M, 33Y, 33K) are formed on the surface. The nozzle rows (33C, 33M, 33Y, 33K) are lined up at regular intervals in the conveying direction, and each of the nozzle rows (33C, 33M, 33Y, 33K) corresponds to an ink of a different color. A cyan ink nozzle row 33C, a magenta ink nozzle row 33M, a yellow ink nozzle row 33Y, and a black ink nozzle row 33K are formed in this example.

Each of the nozzles N is provided with an ink chamber (not shown) and a piezo element. Ink drops are discharged from the nozzles N when the ink chambers are expanded and contracted by the driving of the piezo elements. An image in which dots made of ink drops are arranged in two dimensions on the medium S is formed on the medium S when the head 31 intermittently discharges ink drops during conveyance of the medium S by the control of the controller 10.

A UV irradiation unit 40 includes a metal-halide lamp or other UV light source for irradiating ultraviolet light to cure UV ink, and a drive circuit or the like for lighting the UV light source. A UV light source 41 is provided so as to be arranged on the downstream side in the conveying direction in relation to the head 31 and to extend in the line direction. The irradiation range of ultraviolet light is an area longer than the width of the medium S, which is the print target. The UV irradiation unit 40 causes the UV light source 41 to light up toward the medium S when the medium S is moved in the conveying direction by the control of the controller 10. The UV ink drops on the medium S are thereby cured.

FIGS. 7A to 7D show the printing procedure in the UV printer 1. The drawings show part of a conveying route "r" of the medium S. The conveying unit 20 conveys the medium S to the print area by the conveying roller 22 and the driven roller 23 in accordance with the control of the controller 10 (A), the head unit 30 discharges ink I from the nozzles N of the head 31 toward the medium S, and ink drops d1 are deposited on the medium S (B). The UV light source 41 irradiates the ink drops d1 with ultraviolet light L, and the UV ink drops d1 on the medium S are cured. An image based on the cured UV ink drops d2 is thereby formed. The conveying unit 20 then releases the medium S from the printer 1 by the ejecting roller 25 and a driven roller 26 (D).

Function for Preventing Uneven Gloss

As described above, uneven gloss is produced in UV printers due to the amount of ink per unit area on the medium. The UV printer 1 according to the present embodiment is provided with a medium-deforming unit 60 as a configuration bearing the function for preventing uneven gloss. The operation of the function for preventing uneven gloss in the UV printer 1 of this embodiment is described hereinafter as an example of the invention.

Figure 8:
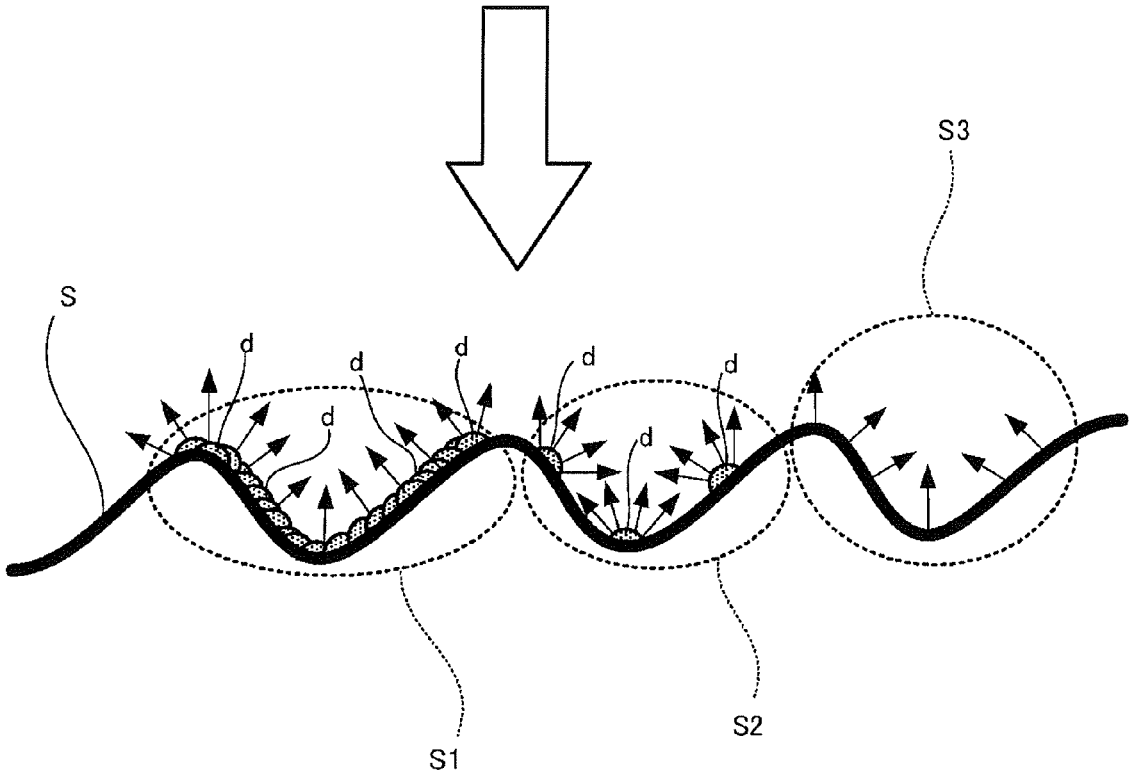
FIG. 8 is a view showing the principle for preventing uneven gloss using the printer in the present embodiment.

FIG. 8 shows the principle for preventing uneven gloss in the UV printer 1. A cross section of the medium S and ink drops "d" deposited on the medium S are shown in the drawing. The principle for preventing uneven gloss in the present example involves deforming the medium S so that an irregular shape in cross section is physically formed before the medium S is conveyed to the print area, as shown in the drawing. Incident light (white arrow in the drawing) is thereby diffusely reflected (solid arrows in the drawing) and a high-density, glossy image area S1 becomes matte in the same manner as the low-density, matte area S2 even when the ink drops "d" deposited on the irregular surface are in the glossy area S1. In addition, physical irregularities can be formed in the same manner even in an area S3 in which there are no ink drops "d" and in which the surface of the medium S is exposed, allowing light reflected from the surface of the medium S to be diffused. As a result, the entire image is made uniformly matte without uneven gloss. FIG. 8 is designed to describe, in simplified form, the principle for preventing uneven gloss, and the relative size of the ink drops "d" and the irregularities on the medium S is substantially different from the actual size.

Figure 9A:
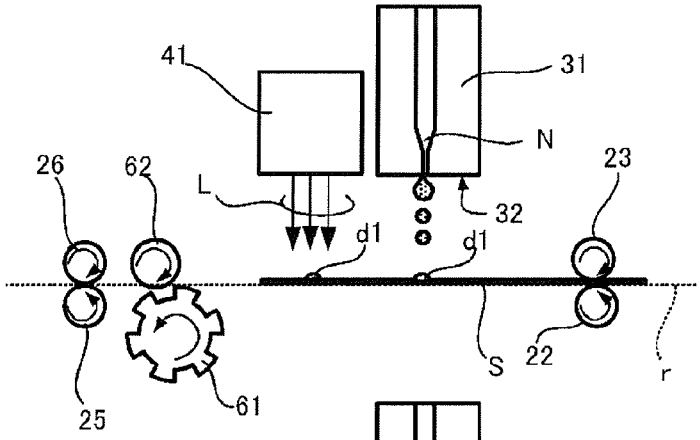
FIG. 9 is a view showing the operation of a function for preventing uneven gloss in the printer of the embodiment.

FIGS. 9A to 9D show the operation of the medium-deforming unit 60 in the UV printer 1. FIG. 9A shows the operation continuing from FIG. 7D, and FIGS. 9B to 9D show the subsequent operation. In the example shown in FIG. 9, a pair of rollers (61, 62) for sandwiching the medium S from above and below is provided between the UV light source 41 and the ejecting roller 25 on the conveying route "r" of the medium S. Physical irregularities are formed on the surface of one of the rollers, 61. The medium-deforming unit 60 includes the roller (medium-deforming roller) 61 provided with irregularities, the driven roller 62 for holding the medium S together with the medium-deforming roller 61, a motor for rotatably driving the medium-deforming roller 61 by the control of the controller 10, and the like. The size of the irregularities on the medium-deforming roller 61 is expressed in an exaggerated manner in FIG. 9 in order to simplify the description.

Figure 9B:
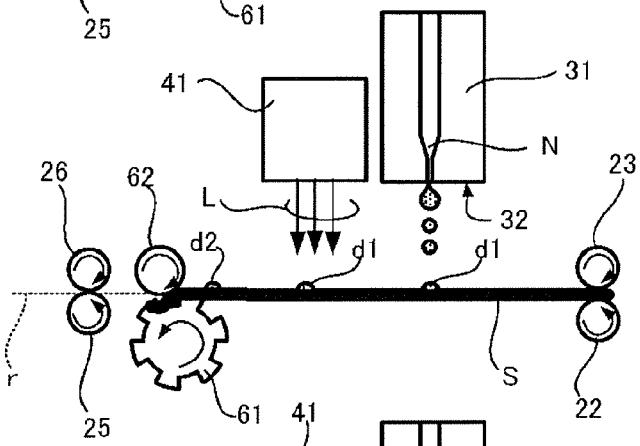
Figure 9C:
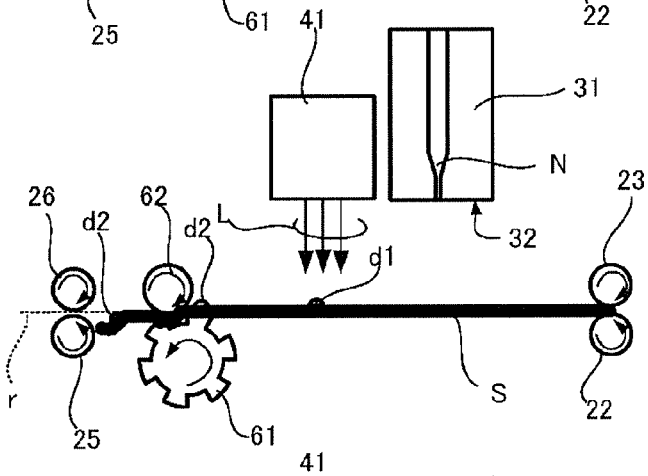
Figure 9D:
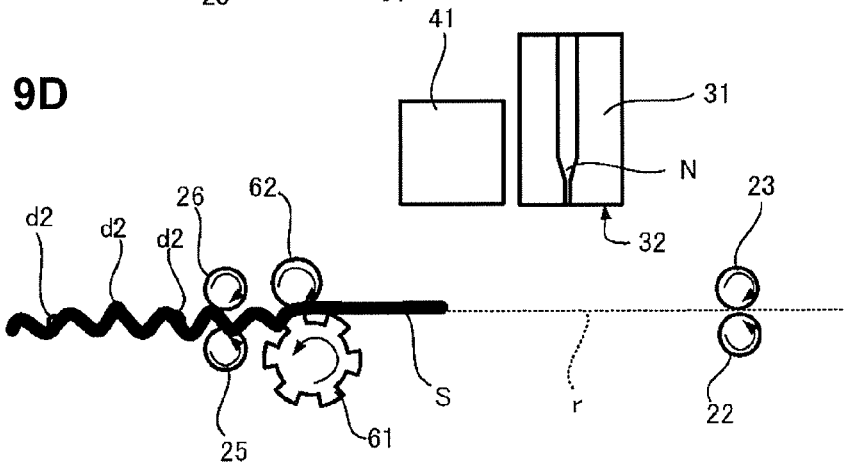

The ink I is first discharged in sequence from the nozzles N of the head 31 toward the upper surface (front surface) Ss of the medium S, the ink drops d1 are deposited on the medium S and irradiated with the ultraviolet light L, and an image based on the cured ink drops d2 is formed on the medium S, as shown in FIG. 9A. The medium S is then pressed against the surface of the medium-deforming roller 61 in the process of being ejected, as shown in FIG. 9B, and the medium S is deformed into a shape provided with physical irregularities in cross section, as shown in FIG. 9C. The medium S is ejected by the ejecting roller 25 and the driven roller 26 while maintaining the irregular shape, as shown in FIG. 9D.

A metal roller provided with irregularities on the surface by machining can be used as the medium-deforming roller 61; a plastic molded article can also be used. In the present embodiment, a metal roller is used in which the surface of the roller is etched and minute irregularities are formed in the surface of the roller in order to make the irregular shape of the medium less structured. In addition, the medium-deforming roller 61 is arranged facing the rear surface Sb of the medium S so as not to damage the front surface Ss of the medium S on which an image is formed.

On the other hand, the driven roller 62 for holding the medium S together with the medium-deforming roller 61 is more preferably a roller in which the surface of the metal roller is coated with, for example, a flexible material such as silicone rubber so as to be able to press down on the medium S without damaging the front surface Ss of the medium S while following the irregular shape of the medium-deforming roller 61. It is apparent that irregularities can also be present on the flexible surface of the driven roller.

As long as the actual depth of the irregularities on the medium S is about the size (diameter) of the ink drops "d", the ink drops form a film shape on a solidly printed or otherwise highly glossy area. Even when this happens, the surface of the film becomes irregularly shaped, the gloss level decreases, and a matte appearance is obtained. In the present example, the size of the ink drops "d" is about 1 μm, and the depth of the irregularities provided to the medium S is also about 1 μm. It is apparent that the depth and pitch of the irregularities formed on the medium S are set in a suitable manner in correspondence with the viscosity that contributes to the size and shape of the ink drops "d," and other characteristics of the ink drops and ink.

Other Embodiments and Examples

Among printers that use light-curable ink, there are types that perform "temporary curing," that is, perform a process in which ink drops are irradiated with low-energy light immediately after deposition to cure the surface of the ink drops. Specifically, performing temporary curing allows the flow of ink to be prevented until the ink drops deposited on the medium are fixed to the medium by high-energy light irradiation. Temporary curing is very effective for the purpose of preventing bleeding, but the uneven gloss described above can become more pronounced.

Figure 10A:
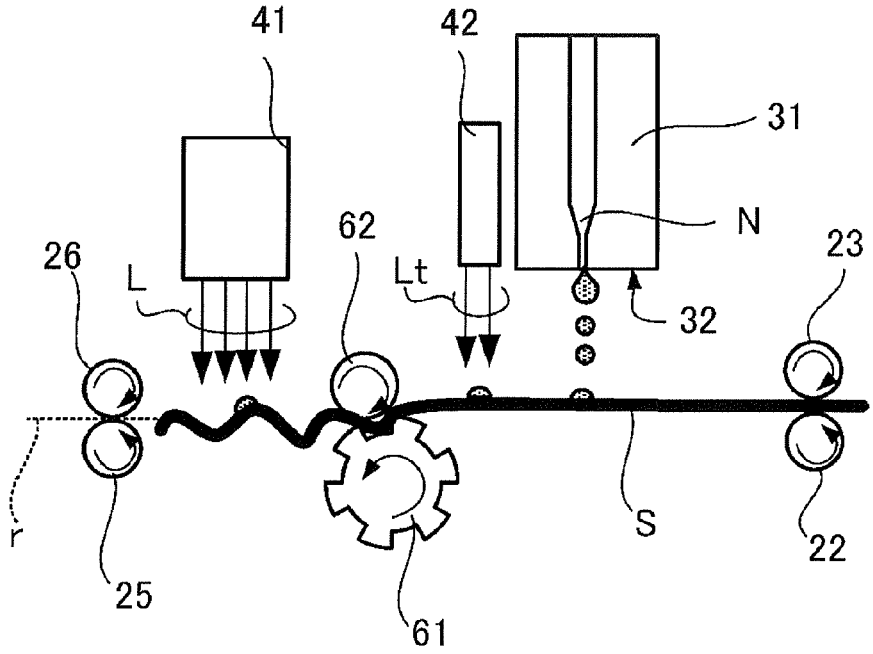
FIG. 10 is a view showing the operation of a function for preventing uneven gloss in the printer according to another embodiment of the invention.
Figure 10B:
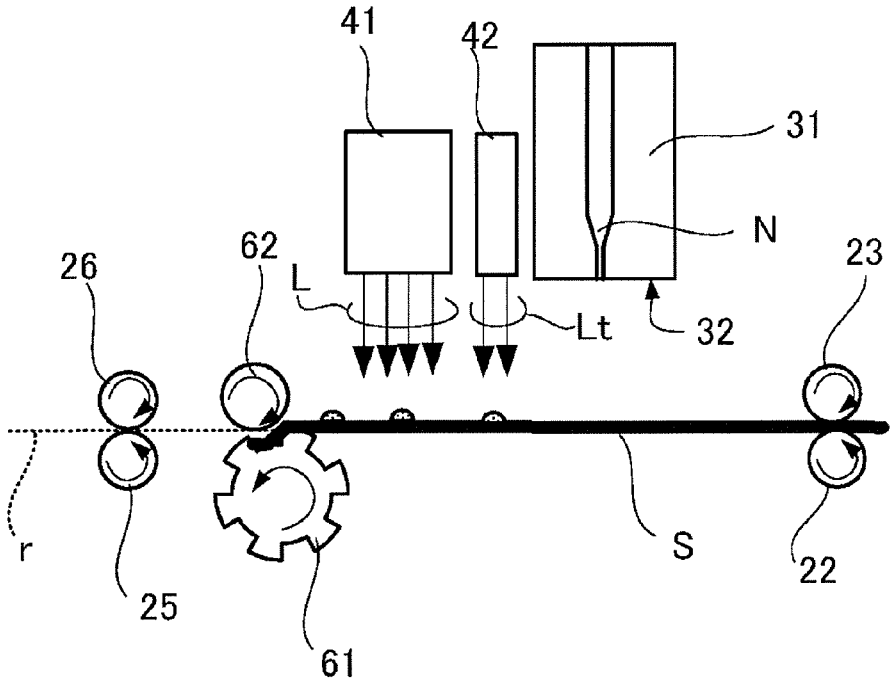

In such temporary curing printers, the aforementioned medium-deforming roller 61 can be arranged on the conveying route "r" of the medium S between a light source for temporary curing and a UV light source 42 or another light source 41 for "permanent curing," the purpose of which is to fix the ink to the medium, as shown in FIG. 10(A). The medium-deforming roller 61 can also be arranged on the downstream side of the light source 41 for permanent curing, as shown in FIG. 10B. It is apparent that the medium-deforming roller can be disposed on the downstream side of the ejecting roller 25.

In addition, the curing of light-curable ink is usually facilitated by the application of heat. In view of this, a heater can be built into the medium-deforming roller 61 in a printer according to any of the aforementioned embodiments, which can or can not include a temporary-curing function, whereby the roller can aid in fixing the image at the same time that the medium is deformed. In other words, the irradiation energy of the light required for permanent curing can be reduced in comparison with a case in which heat is not applied. It can thereby be expected that the configuration of the printer will be simplified, and a smaller printer can be attained.

Specifically, the ink drops d1 deposited on the medium S in the UV printer 1 of this embodiment are irradiated with high-energy ultraviolet light, hardened, and fixed to the medium S, as shown in FIG. 7 above. Accordingly, the head 31 and the UV light source 41 must be arranged at a certain distance from each other so as to prevent clogging in the nozzles N when the lower surface 32 of the head 31 is irradiated with ultraviolet light as well as reflected light from the UV light source 41. A gap for accommodating a light-blocking structure is required when the blocking structure is interposed between the head 31 and the UV light source 41. However, reducing the irradiation energy of the UV light source 41 allows the head 31 and the UV light source 41 to be arranged nearer to each other, a smaller configuration to be attained, and the light-blocking structure to be omitted.

The UV printer 1 according to this embodiment is a line printer, but can be a serial printer. Specifically, a serial printer can have a configuration in which the head moves in a direction intersecting with the conveying direction, rather than a configuration in which the head is arranged in the line direction across the width of the medium S.

In the UV printer 1 according to this embodiment, an example is given of a piezo inkjet printer in which voltage is applied to a driving element (piezo element) to spray fluid by causing the expansion and contraction of an ink chamber, but the method for discharging fluid is not limited to this example, and a thermal inkjet printer can also be used in which bubbles are formed in the nozzles using a heater element, and liquid is sprayed by the bubbles.

In addition, in each of the printers according to the various embodiments of the invention, beginning with the UV printer 1 according to this embodiment, the medium is not limited to paper, and a plastic film or another medium having any form can be a print target as long as the irregular shapes applied prior to printing are maintained. It is apparent that the medium can be of a continuously conveyed form such as rolled paper, and can be of an individually conveyed form such as a single sheet of paper.

The conveying direction of the medium is such that the side on which the medium is supplied is the upstream side, and the side on which the medium is released is the downstream side, but the conveying direction is not limited to a unidirectional configuration from upstream to downstream. As shown, for example, in FIG. 4, a case is also possible in which the medium S is supplied from the front side and is released from the same front side after printing. In such a case, a structure is preferably adopted in which the medium-deforming roller 61 and the driven roller 62 can hold and release the medium S, and the controller 10 preferably controls the hold and release operations. The control procedure is preferably such that the medium S is not held in the process of being supplied until reaching the print area, and the medium S is held in the process of being ejected after an image is formed. In any case, the medium is preferably deformed so as to have an irregular shape in cross section after the image is formed on the medium S.

INDUSTRIAL APPLICABILITY

The invention can be applied to inkjet printers for forming images using light-curable ink on, for example, media (OHP sheet, coated paper, and the like) that usually has low ink penetration.

What is claimed is:

1. A printing apparatus for depositing ink droplets on a surface of a medium to form an image, the printing apparatus comprising:

a medium-conveying part, nozzles, a light-irradiation part, a medium-deforming part, and a controller for controlling the parts, the medium-conveying part conveying the medium so that the medium supplied from an upstream side is released on a downstream side;

the nozzles discharging ink droplets curable by light irradiation onto the medium;

the light-irradiation part irradiating the medium with light;

the medium-deforming part including a pair of rollers arranged on the downstream side of the light-irradiation part, with the pair of rollers being configured to sandwich the medium from above and below with respect to a conveying direction to deform the medium so that an irregular shape is formed in cross section;

the controller performing an image-forming step, a light-irradiating step, and a medium-deforming step;

in the image-forming step, the ink droplets being discharged by the nozzles to form an image on the surface of the medium;

in the light-irradiating step, the ink droplets discharged onto the medium being irradiated with light by the light-irradiation part to cure the droplets; and in the medium-deforming step, the medium being released by the medium-conveying part after the medium is deformed by the medium-deforming part.

2. The printing apparatus according to claim 1, wherein the pair of rollers is configured to sandwich the medium while being orthogonal to the conveying direction of the medium, and irregularities are formed on the surface of one of the rollers.

3. The printing apparatus according to claim 2, further comprising a heating part for applying heat to the rollers, the rollers being made to facilitate the curing of the ink droplets by applying heat to the medium when the medium is deformed.

4. The printing apparatus according to claim 2, wherein the surface of the medium on which the ink droplets are deposited is the front surface, the roller provided with irregularities is arranged facing the rear surface of the medium, and the roller provided with an elastic surface and formed from a material lacking any irregularities is arranged facing the front surface.

5. The printing apparatus according to claim 1, wherein the light-irradiation part arranged downstream of the head part further includes a temporary-curing irradiation part on the upstream side, and a permanent-curing irradiation part on the downstream side;

the medium-deforming part is arranged on the downstream side of the temporary-curing irradiation part and on the upstream side of the permanent-curing part;

the controller performs a temporary curing step and a permanent curing step, and performs the light-irradiating step after the temporary curing step;

the temporary-curing irradiation part irradiates light for preventing the flow of the ink droplets;

the permanent-curing irradiation part irradiates light having higher energy in comparison with the light irradiated by the temporary-curing irradiation part;

in the temporary curing step, the ink droplets deposited on the medium by the nozzles are irradiated with light by the temporary-curing irradiation part; and in the permanent curing step, the ink droplets irradiated with light in the temporary curing step are irradiated with light, cured, and fixed to the medium.

6. The printing apparatus according to claim 1, wherein the light-irradiation part arranged downstream of the head part further includes a temporary-curing irradiation part on the upstream side, and a permanent-curing irradiation part on the downstream side;

the medium-deforming part is arranged on the downstream side of the permanent-curing part;

the controller performs a temporary curing step and a permanent curing step, and performs the medium-deforming step after the permanent curing step;

the temporary-curing irradiation part irradiates light for preventing the flow of the ink droplets;

the permanent-curing irradiation part irradiates light having higher energy in comparison with the light irradiated by the temporary-curing irradiation part;

in the temporary curing step, the ink droplets deposited on the medium by the nozzles are irradiated with light by the temporary-curing irradiation part; and in the permanent curing step, the ink droplets irradiated with light in the temporary curing step are irradiated with light, cured, and fixed to the medium.

7. A printing method using a printing apparatus in which light-curable ink is discharged as droplets from nozzles and deposited on a medium, the deposited droplets being irradiated with light and cured, and an image composed of minute dots being formed on the medium, the printing apparatus performs a step of deforming the medium so that an irregular shape is formed in cross section by a pair of rollers sandwiching the medium from above and below with respect to a conveying direction after a step for irradiating the droplets deposited on the medium with light to cure the droplets.

* * * * *